United States Patent [19]

Uyetake et al.

[11] 4,000,584

[45] Jan. 4, 1977

[54] IN-SITU LAPPING APPARATUS FOR GATE VALVES

[75] Inventors: Tadao Uyetake, Honolulu; Teikichi Higa, Pearl City; Stephen Orillo, Jr., Wahiawa; Gregory Nakano, Pearl City, all of Hawaii

[73] Assignee: The United States of America as represented by the Secretary of the Navy, Washington, D.C.

[22] Filed: Apr. 1, 1976

[21] Appl. No.: 672,579

[52] U.S. Cl. ..... 51/241 VS; 51/241 S

[51] Int. Cl.[2] ..... B24B 19/00

[58] Field of Search ..... 57/241 VS, 241 S; 90/12.5

[56] References Cited

UNITED STATES PATENTS

| | | | |
|---|---|---|---|
| 1,993,844 | 3/1935 | Karnath | 51/241 VS X |
| 2,360,009 | 10/1944 | Norton | 51/241 VS |
| 2,360,550 | 10/1944 | Culp | 51/241 VS |

FOREIGN PATENTS OR APPLICATIONS

| | | | |
|---|---|---|---|
| 122,715 | 2/1959 | U.S.S.R. | 51/241 VS |

*Primary Examiner*—Al Lawrence Smith
*Assistant Examiner*—James G. Smith
*Attorney, Agent, or Firm*—Richard S. Sciascia; Ervin F. Johnston

[57] ABSTRACT

A lapping apparatus for in-situ grinding of valve body seats of a gate valve which includes a pair of plugs which are expandable within the inlet and outlet of openings of the gate valve for retention therein, a pair of grinding discs which are rotatably mounted on the plugs with freedom of reciprocal movement along the axes of rotation for grinding the valve body seats, a rod with an enlarged end which is extendable into the valve body for engaging the grinding discs and biasing them along the axes of rotation against the valve body seats, and a tube for receiving the rod and extendable into the valve body for engaging and driving the grinding discs about the axes of rotation.

10 Claims, 2 Drawing Figures

38
38
16
26
18
18
44
32
30
34
22
36
40
20
28
24
42
12
12
16
60
46
58
10
48
54
52
56
14
50
16
26
18
18
48
32
44
38
30
34
22
40
36
20
38
16
28
24
12
12
42

IN-SITU LAPPING APPARATUS FOR GATE VALVES

STATEMENT OF GOVERNMENT INTEREST

The invention described herein may be manufactured and used by or for the Government of the United States of America for governmental purposes without the payment of any royalties theron or therefor.

BACKGROUND OF THE INVENTION

The present invention relates to an in-situ lapping apparatus for grinding valve body seats of a gate valve.

Ships and submarines are large users of gate valves within their various piping systems. These piping systems are periodically inspected for leaks which are caused by normal operational fatigue. Most leaks are caused by improper seating of the wedge-shaped gate with the pair of valve body seats. Excessive wear of these valve body seats are refurbished in the same manner as valve seats of the ordinary combustion engine. The valve seats are ground smooth again so that proper sealing takes place. This is especially important in critical fluid systems aboard ships or submarines.

Normally, valve body seats are resurfaced in place within the piping system, using the gate as the lapping tool with the aid of a grinding compound and/or by the use of a tool which is similar to the gate valve. This approach has not been satisfactory in three primary instances: (1 where cleanliness is to be maintained within the piping system, (2 where the sealing surfaces are extremely defaced, and/or (3 where the allowable geometric tolerances of the sealing surfaces are close.

SUMMARY OF THE INVENTION

The present invention provides a lapping apparatus for in-situ simultaneous grinding of a pair of extremely defaced valve body seats of a gate valve within close geometric tolerances while maintaining cleanliness of the adjacent piping systems. This has been accomplished by providing a pair of plugs which are expandable within the inlet and outlet openings of the gate valve for retention therein, a pair of grinding discs which are rotatably mounted on the plugs with freedom of reciprocal movement along the axes of rotation for grinding the valve body seats, a rod with an enlarged end which is extendable into the valve body for engaging the grinding discs and biasing these discs along the axes of rotation against the valve body seats, and a tube for receiving the rod and extendable from the valve body for engaging and driving the grinding discs about their axes of rotation.

OBJECTS OF THE INVENTION

An object of the present invention is to provide a lapping apparatus for in-situ grinding of valve body seats which overcomes the problems of prior art lapping apparatuses.

Another object is to provide a lapping apparatus for in-situ grinding of badly defaced valve body seats within close geometric tolerances.

A further object is to provide a lapping apparatus for in-situ simultaneous grinding of a pair of badly defaced valve body seats within close geometric tolerances while maintaining cleanliness with adjacent piping systems.

A further object is to provide a lapping apparatus which will fill the functions of the previous object but yet can be operated by hand outside of the valve body.

These and other objects of the invention will become more readily apparent from the ensuing description when taken together with the drawings.

DESCRIPTION OF THE PREFERRED EMBODIMENT

Figures 1, 2:
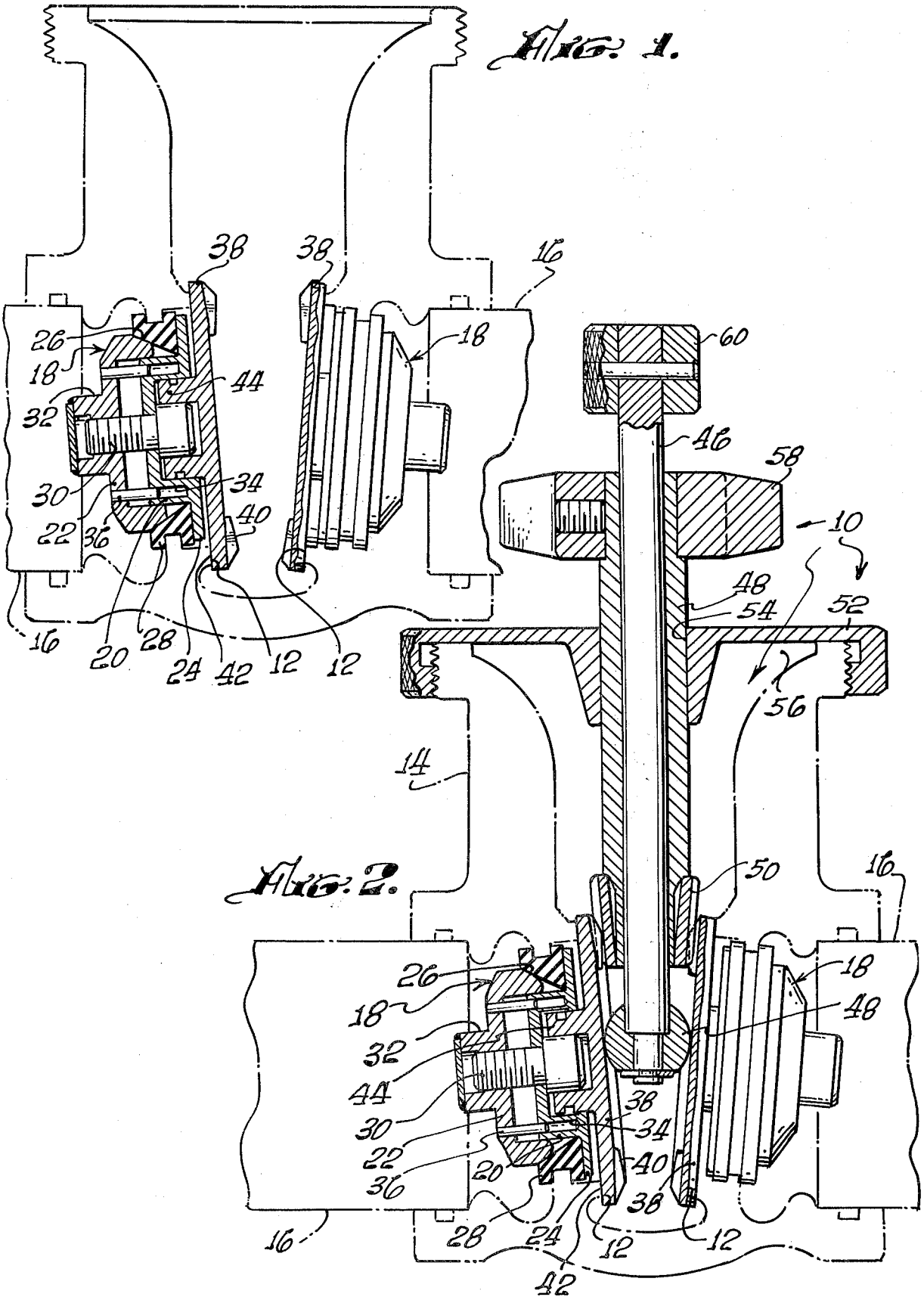
FIG. 1 is a side view of a pair of plugs and grinding discs partly in cross section, shown in place within a gate valve body which is shown in phantom.
FIG. 2 is a view similar to FIG. 1 except a pair of grinding discs and a rod and tube combination are additionally shown mounted within the valve body.

Referring now to the drawings, wherein like reference numerals designate like or similar parts throughout the several views, there is illustrated in FIG. 2 a lapping apparatus 10 for in-situ grinding of a pair of valve body seats 12 of a gate valve 14. A portion of the lapping apparatus 10 is illustrated in FIG. 2 to clarify the separable nature of it components. The gate valve 14 is shown in phantom with the gate and spindle removed. Also, upstream and downstream pipes 16 are illustrated in phantom extending from the inlet and outlet of the valve body, depending upon which way the fluid is moving.

The lapping apparatus 10 includes a plug means which is expandable within the inlet and outlet openings of the gate valve 14 for retention therein. This plug means may include a pair of plugs 18 which are identical, the plug on the left side being described in detail herein. The plug 18 includes a pair of cylindrical cups 20 and 22, the cup 20 being smaller and being reciprocally slidable within the larger cup 22. The smaller cup 20 has an annular outwardly extending flange 24, and the rim of the larger cup 22 has an annular bevel 26.

A resilient ring 28 is mounted about both the bevelled rim 26 of the larger cup and the rim of the smaller cup 20, and is disposed adjacent to the flange 24. A bolt 30 may extend through the base of the smaller cup 20 and may be threaded into the base of the larger cup 22. With this arrangement, a tightening or loosening of the bolt 30 will respectively expand or retract the resilient ring 28 within the inlet or outlet of the valve 14. An expansion of the resilient ring 28 within the gate valve opening will provide a seal of the opening and a support for a purpose to be explained hereinafter.

The sealing of the valve opening is further ensured by providing a secondary cup 32 centrally located on the outside of the base of the larger cup 22 for receiving the extension of the threaded end of the bolt 30. It should be noted that the smaller cup 20 is axially reciprocable within the larger cup 22 for expanding the resilient ring 28 over the annular bevel 26 of the larger cup 22. Additional guidance in this reciprocal motion may be provided by recesses 34 within the smaller cup 20 which receive guide pins 36 extending from the base of the larger cup 22.

The lapping apparatus 10 further includes means rotatably mounted on the plug means with freedom of reciprocal movement along the axes of rotation for grinding the valve body seats 12. This grinding means may include a pair of identical circular discs 38, the left disc being described in detail herein. The disc 38 has gear teeth 40 on one face and a grinding surface 42 on an opposite face. The latter face of the grinding disc 38 may be provided with a centrally located hub 44 which is rotatably mounted within the recess of the smaller cylindrical cup 20 with freedom of slidable reciprocable movement along its axis of rotation. Accordingly, the plug 18 serves as a support for the grinding disc 38 to rotate on, to enable grinding of the valve seats 12. The description of the lapping apparatus 10 up to this point includes the components illustrated in FIG. 1.

As illustrated in FIG. 2, the lapping apparatus 10 further includes means extendable into the valve body 14 for engaging the grinding discs 38 and biasing these discs along their axes of rotation against the valve body seats 12. This biasing means may include a rod 46 which has a bottom spherical portion 48 of greater diameter than the rod for engaging the gear side of each respective grinding disc 38. In this manner, the rod 46 can be pushed down manually to bias the grinding discs 38 against the valve body seats 12 so that when the grinding discs are rotated the resurfacing function of the valve seats is implemented. It is desirable that the spherical portion 48 of the biasing means be of a diameter which enables engagement with the grinding discs in close proximity to their axes of rotation so that even pressure is applied around the periphery of the valve seats 12.

The lapping apparatus 10 further includes means extendable into the valve body 14 for engaging and driving the grinding discs 38 about their axis of rotation. This driving means may include a tube 48 and a pinion gear 50, the pinion gear 50 being mounted about one end portion of the tube for simultaneously engaging teeth of the gears 40 on both of the grinding discs 38. It is preferred that the pinion gear 50 be made of a resilient material such as rubber for smooth engagement of the gears on the grinding discs.

The lapping apparatus 10 further includes a cap 52 which is threaded on the bonnet end of the gate valve 14. The cap 52 has a central opening 54 for slidably receiving the tube 48 of the driving means. The cap 52 may be provided with viewing ports 56 for visually inspecting the grinding while it is in process.

The tube 48 of the driving means may extend outside of the valve body 14 beyond the cap 52, and may be provided with a handle 58 mounted on its uppermost end. The rod 46 of the biasing means may extend beyond the handle 58 and may be provided with a handle 60 at its uppermost top end. In this manner, the handle 60 may be pushed downwardly with one hand of the operator while the handle 58 is rotated by the other hand of the operator to implement the grinding operation of the valve seats 12.

OPERATION OF THE INVENTION

In the operation of the invention, the plugs 18 are first inserted into the inlet and outlet openings of the valve body 14 to seal these openings and provided a rotatable support for the grinding discs 38. Before tightening the resilient ring 28 against the respective opening the respective grinding disc 38 is placed in position to ensure that the plug is properly oriented for precise grinding of the valve seat. The grinding disc is then removed and the respective plug is tightened into place by tightening down on the bolt 30 and expanding the resilient ring 28. After placement of both plugs 18, both grinding discs 38 are rotatably installed on the plugs, and the remainder of the assembly including the tube 48, the rod 46, and the cap 52 are placed into position as illustrated in FIG. 2. The operator then holds down on the handle 60 with one hand while turning the handle 58 with his other hand to implement the grinding function of the valve seats 12. This arrangement will allow in-situ grinding of the valve body seats simultaneously while maintaining sealing integrity of the adjacent piping systems 16. The lapping apparatus 10 is simple to operate and ensures grinding of the valve seats to close tolerances even though the seats may be badly defaced.

Obviously, many modifications and variations of the present invention are possible in the light of the above teachings, and, it is therefore understood the invention may be practiced otherwise than as specifically described:

What is claimed is:

1. A lapping apparatus for in-situ grinding of valve body seats of a gate valve comprising:

plug means expandable within the inlet and outlet openings of the gate valve for retention therein;

means rotatably mounted on the plug means with freedom of reciprocable movement along the axes of rotation for grinding the valve body seats;

means extendable into the valve body for engaging the grinding means and biasing the grinding means along the axes of rotation against the valve body seats, and means extendable into the valve body for engaging and driving the grinding means about said axes of rotation.

2. A lapping apparatus as claimed in claim 1 including:

the grinding means being a pair of circular discs, each disc having gear teeth on one face and a grinding surface on the opposite face;

each circular disc having a central axis which coincides with its axis of rotation and having freedom of reciprocable movement therealong; and the biasing means being a rod with an enlarged portion for engaging the gear side of each grinding disc so that the rod can be pushed to bias the grinding surfaces against the valve body seats as the grinding discs are driven about their axes of rotation.

3. A lapping apparatus as claimed in claim 2 including:

the driving means comprising a tube and a pinion gear, the pinion gear being mounted about one end portion of the tube for simultaneously engaging the teeth of the gears on both of the grinding discs.

4. A lapping apparatus as claimed in claim 1 including:

the plug means making sealing engagement with the inlet and outlet openings of the gate valve.

5. A lapping apparatus as claimed in claim 4 wherein the plug means includes:

two pairs of cylindrical cups;

one cup of each pair of cups being smaller and reciprocably slidable within the other respective cup;

each of the smaller cups having an annular outwardly extending flange and the rim of each of the larger cups having an annular bevel;

a resilient ring mounted about both the bevelled rim of each larger cup and the rim of the respective smaller cup, and is disposed adjacent to the respective flange;

screw means extending through the base of the smaller cup of each pair of cups and threaded into the base of the respective larger cup, whereby tightening or loosening the screw means will respectively expand or contract the resilient ring.

6. A lapping apparatus as claimed in claim 5 including:

the grinding means being a pair of circular discs, each disc having gear teeth on one face and a grinding surface on the opposite face; and each disc having a hub which is rotatably mounted within a respective smaller cylindrical cup with freedom of reciprocable movement along its axis of rotation.

7. A lapping apparatus as claimed in claim 6 including:

the biasing means comprising a rod with a spherical portion of greater diameter for engaging the gear side of each grinding disc so that the rod can be pushed to bias the grinding surfaces against the valve body seats as the grinding discs are driven about their axes of rotation.

8. A lapping apparatus as claimed in claim 7 including:

the driving means comprising a tube and a pinion gear, the pinion gear being mounted about one end portion of the tube for simultaneously engaging the teeth of the gears on both of the grinding dics.

9. a lapping apparatus as claimed in claim 8 including:

a cap threadable on the top of the valve and having a central opening for slidably receiving the tube of the driving means.

10. a lapping apparatus as claimed in claim 9 including:

the tube of the driving means extending outside the valve body beyond the cap and having a handle mounted on its outside end; and the rod of the biasing means extending beyond the handle on the driving means and having a handle at its outside end.

* * * * *